US010744755B2

(12) United States Patent
Fisher

(10) Patent No.: US 10,744,755 B2
(45) Date of Patent: Aug. 18, 2020

(54) APPLICATION OF COATING FLUID USING MOVABLE ROLLERS

(71) Applicant: HP INDIGO B.V., Amstelveen (NL)

(72) Inventor: Gil Fisher, Shoham (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/521,806

(22) PCT Filed: Dec. 29, 2014

(86) PCT No.: PCT/EP2014/079371

§ 371 (c)(1),
(2) Date: Apr. 25, 2017

(87) PCT Pub. No.: WO2016/107631

PCT Pub. Date: Jul. 7, 2016

(65) Prior Publication Data

US 2017/0246855 A1 Aug. 31, 2017

(51) Int. Cl.

| | |
|---|---|
| ***B41F 19/00*** | (2006.01) |
| ***B05C 1/08*** | (2006.01) |
| ***B41F 23/00*** | (2006.01) |
| ***G03G 15/16*** | (2006.01) |
| ***B41F 23/08*** | (2006.01) |

(Continued)

(52) U.S. Cl.

CPC ..... *B41F 23/00* (2013.01); *B05C 1/083* (2013.01); *B05C 1/0813* (2013.01); *B05C 1/0834* (2013.01); *B41F 19/001* (2013.01); *B41F 19/002* (2013.01); *B41F 23/08* (2013.01); *G03G 15/1695* (2013.01); *G03G 15/6558* (2013.01); *G03G 15/6585* (2013.01); *B41F 7/02* (2013.01);

(Continued)

(58) Field of Classification Search

None

See application file for complete search history.

(56) References Cited

U.S. PATENT DOCUMENTS

| | | | |
|---|---|---|---|
| 5,549,751 | A | 8/1996 | Brinkmeier et al. |
| 6,447,178 | B2 | 9/2002 | Thering et al. |

(Continued)

FOREIGN PATENT DOCUMENTS

| | | |
|---|---|---|
| CN | 1863674 | 11/2006 |
| CN | 104185553 | 12/2014 |

(Continued)

OTHER PUBLICATIONS

Unknown, About Roll Coaters [online], Retrieved from the Internet: <http://www.schaeferco.com/about_rollcoaters.html > [retrieved on Oct. 13, 2014], 13 pages.

*Primary Examiner* — Binu Thomas

(74) *Attorney, Agent, or Firm* — HP Inc. Patent Department

(57) ABSTRACT

Examples disclosed herein relate to application of a coating fluid. Examples include an apparatus including a first coating applicator to apply a coating fluid to a plurality of first rollers; a first transfer roller in contact with the plurality of first rollers to receive coating fluid; and a media path to apply coating fluid from the first transfer roller to a first side of a media, wherein the plurality of first rollers are shorter than the first transfer roller and are individually movable along its longitudinal axes such that they may positioned to apply a variable width of coating fluid onto the first transfer roller.

12 Claims, 6 Drawing Sheets

(51) Int. Cl.
*G03G 15/00* (2006.01)
*B41F 31/15* (2006.01)
*B41F 7/02* (2006.01)

(52) U.S. Cl.
CPC .... *B41F 31/15* (2013.01); *G03G 2215/00801* (2013.01)

(56) References Cited

U.S. PATENT DOCUMENTS

| | | | | |
|---|---|---|---|---|
| 6,935,734 | B2 | 8/2005 | Askren et al. | |
| 6,959,849 | B2 | 11/2005 | Burdenko | |
| 2005/0169678 | A1* | 8/2005 | Baskin | G03G 15/2025 399/324 |
| 2007/0051256 | A1* | 3/2007 | Riedel | B41F 9/063 101/153 |
| 2015/0010692 | A1* | 1/2015 | Feygelman | G03G 15/1695 118/712 |

FOREIGN PATENT DOCUMENTS

| | | | | |
|---|---|---|---|---|
| DE | 3011031 | A1 * | 10/1981 | B41F 7/02 |
| EP | 2805825 | A1 | 11/2014 | |
| GB | 964463 | A * | 7/1964 | |
| WO | WO-2013113376 | A1 | 8/2013 | |
| WO | WO-2014063731 | A1 | 5/2014 | |

* cited by examiner

APPLICATION OF COATING FLUID USING MOVABLE ROLLERS

CROSS-REFERENCE TO RELATED APPLICATION

This application is a U.S. National Stage Application of and claims priority to International Patent Application No. PCT/EP2014/079371, filed on Dec. 29, 2014, and entitled "APPLICATION OF COATING FLUID."

BACKGROUND

Digital printing presses offer a way to print on a variety of print medium, such as a paper substrate, a foil substrate, and a plastic substrate.

BRIEF DESCRIPTION OF THE DRAWINGS

The following detailed description references the drawings, wherein.

DETAILED DESCRIPTION

In the following discussion and in the claims, the term "couple" or "couples" is intended to include suitable indirect and/or direct connections. Thus, if a first component is described as being coupled to a second component that coupling may, for example, be: (1) through a direct electrical or mechanical connection, (2) through an indirect electrical or mechanical connection via other devices and connections, (3) through an optical electrical connection, (4) through a wireless electrical connection, and/or (5) another suitable coupling. The term "approximately" as used herein to modify a value is intended to be determined based on the understanding of one of ordinary skill in the art, and can, for example, mean plus or minus 10% of that value.

A number of coating fluids may be applied to a print medium to facilitate printing. This process may be referred to as priming. For example, a print medium may be primed before printing an image using printing material, for example, printing fluids (e.g., inks, etc.), printing compounds, etc. Priming can increase the color gamut printable on the print medium, improve fixing of a printed image on the print medium, i.e., durability of the printing material when printed, and/or enable additional degrees of freedom to the ink and printing process design.

A roller may be used to apply the coating fluid to the print medium in a printing press. The size or width of a print medium may vary. To facilitate printing on medium of varying widths, at least one roller in a media path of the printing press should include coating fluid of a width matched to a printing width of the print medium. In an example, a layer of coating fluid is applied evenly on the print medium via the use of two rollers, a first roller to pick up the coating fluid and transfer it to a second roller to provide the coating fluid to the print medium. However, replacing the first roller or the second roller to provide a coating fluid of varying width is a time and labor consuming process. A roller may be manually replaced with a roller having a contact portion of the determined printing width. In addition, pre-manufacturing the replaceable roller to the determined printing width for multiple different printing mediums and keeping an inventory of rollers with the commonly used print width is costly.

To address these issues, in the examples described herein, a system that can adjust the width of a coating fluid applied to a roller in a printing press is provided. The system includes a pickup roller which can be moved along a longitudinal axis to provide coating fluid at a desired location and varied width. In some examples, a second pickup roller may also be moved along a longitudinal axis to vary a width of coating fluid applied to the print medium.

Figure 1:
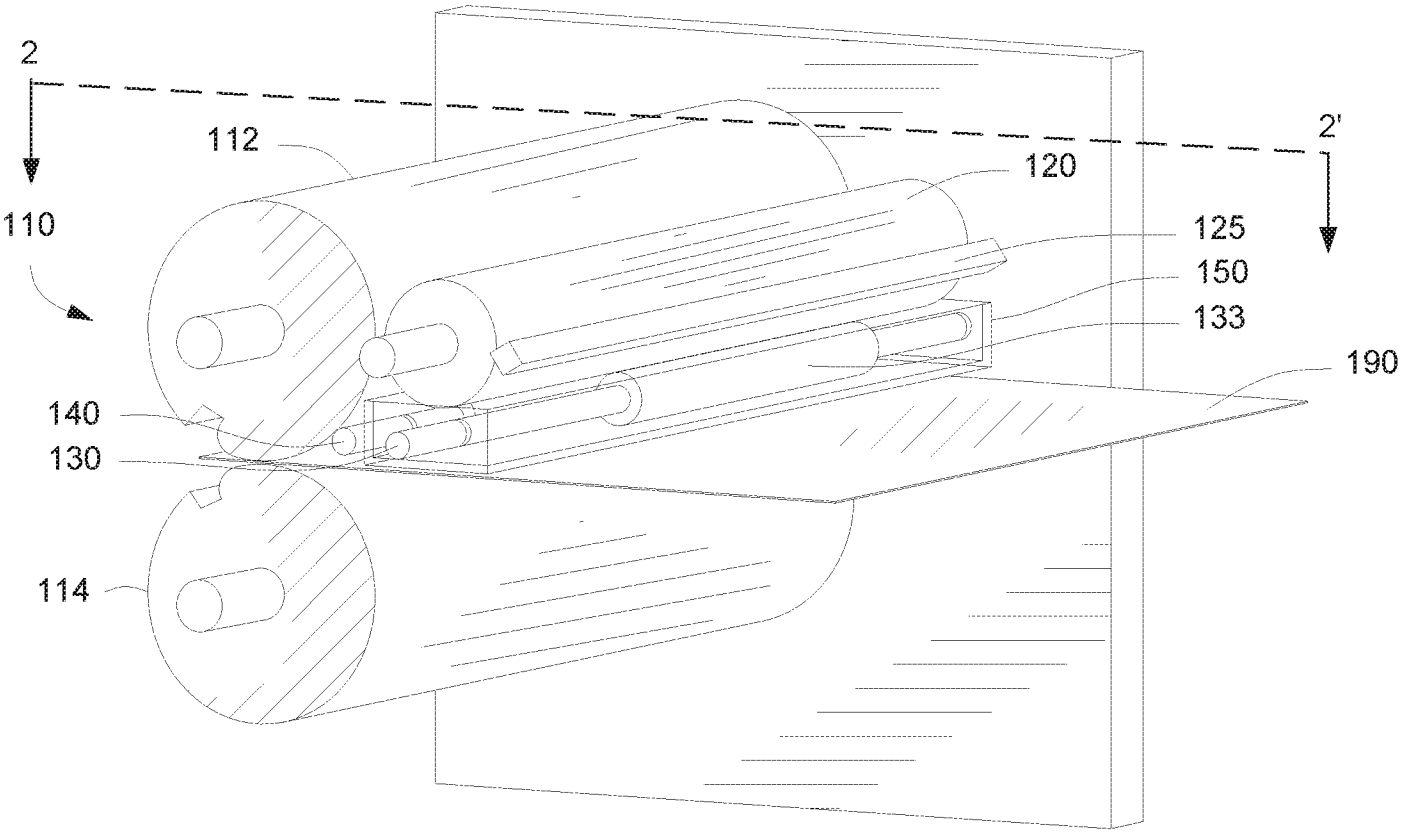
FIG. 1 is a partial schematic front perspective view of a printing press according to an example.
Figure 2:
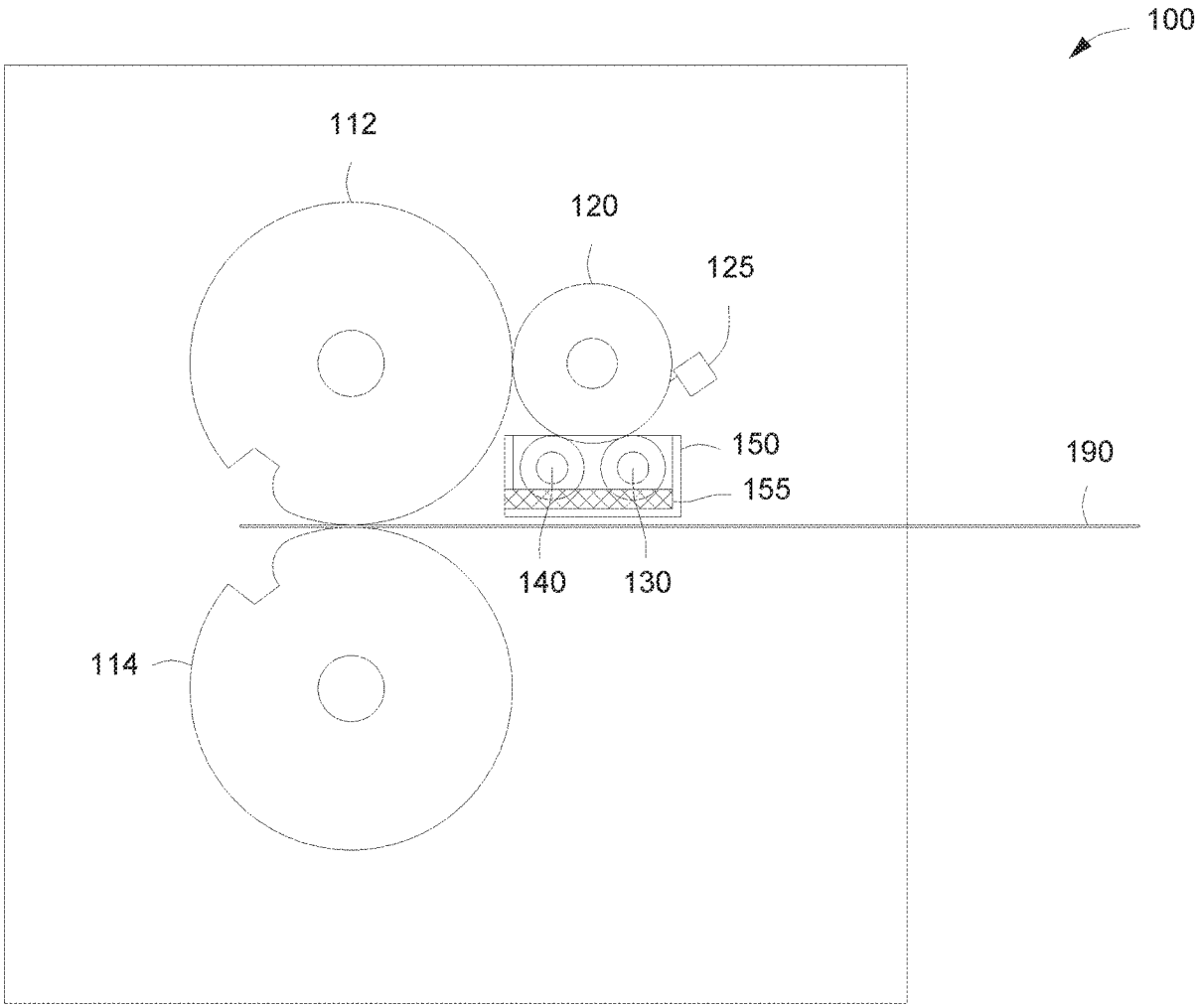
FIG. 2 is a schematic cross-sectional view of the printing press of FIG. 1 taken along line 2-2' according to an example.
Figure 3:
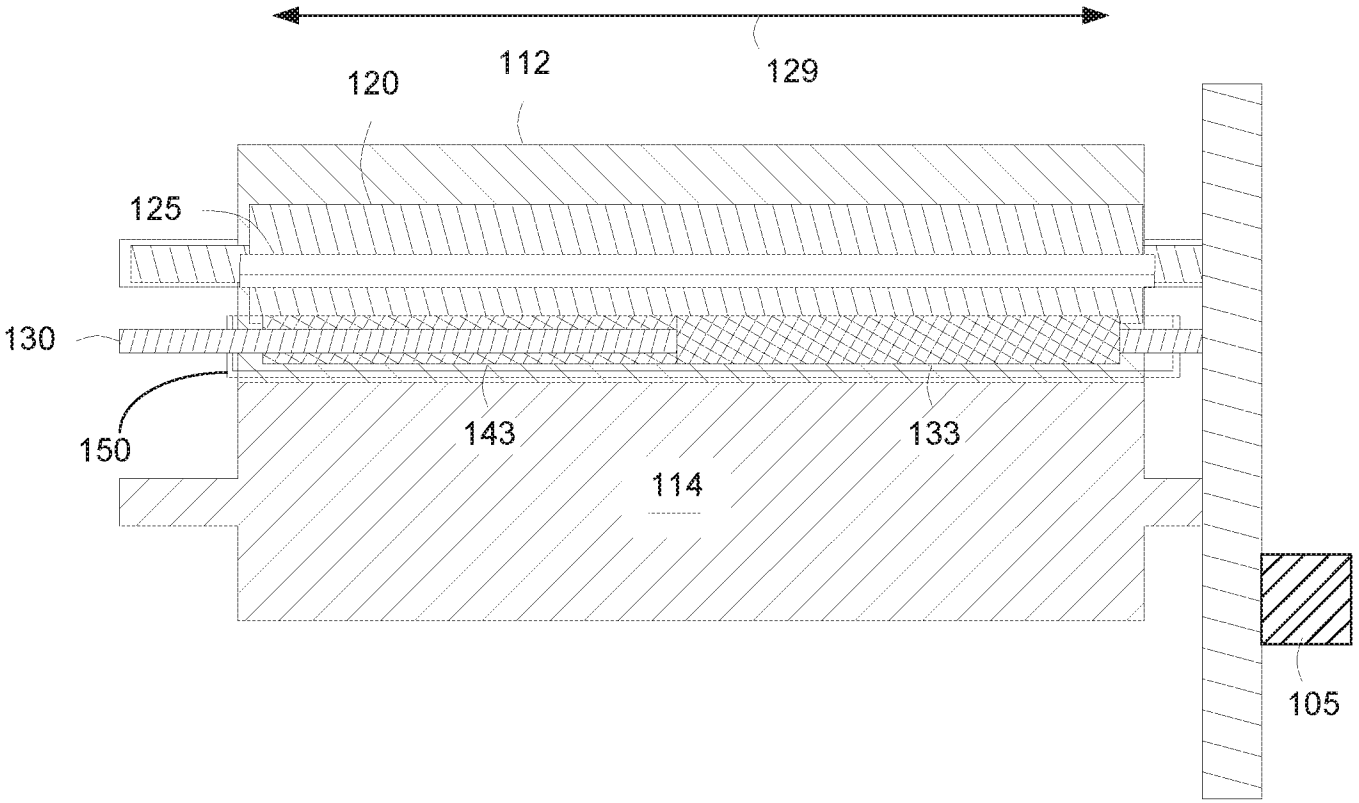
FIG. 3 is a partial schematic side perspective view of the printing press of FIG. 1 according to an example.

Referring now to the drawings, FIG. 1 is a partial schematic front perspective view of a printing press 100 according to an example. FIG. 2 is a schematic cross-sectional view of the printing press 100 of FIG. 1 taken along line 2-2' according to an example. FIG. 3 is a partial schematic side perspective view of the printing press of FIG. 1 according to an example. Referring to FIGS. 1-3, printing press 100 includes a media path 110 along which a first press roller 112 is rotationally coupled to a second press roller 114 to transfer a coating fluid onto a print medium 190 on media path 110. In the example of FIG. 1, first press roller 112 is to apply a coating fluid to one side of print medium 190. In some examples, first press roller 112 may deposit a coating fluid having a thickness of approximately 0.1-10 micrometers on print medium 190.

A transfer roller 120 is rotationally coupled with first press roller 112 to provide the coating fluid. Transfer roller 120 may receive the coating fluid from a first pickup roller 130 and a second pickup roller 140. Although depicted with two pickup rollers (first pickup roller 130 and second pickup roller 140), the examples are not limited thereto and any number of pickup rollers may be used.

First pickup roller 130 and second pickup roller 140 may be in a fluid reservoir 150 to pick up the coating fluid from fluid reservoir 150 to provide to first transfer roller 120. Coating fluid 150 may include any fluid or compound to be disposed on print medium 190 including a primer, a toner, an printing material, a finishing fluid, etc. First pickup roller 130 includes a contact part 133 which is rotationally coupled to transfer roller 120 to provide the coating fluid. Contact part 133 has a longitudinal length less than or equal to the longitudinal length of transfer roller 120 to provide coating fluid to a portion of transfer roller 120. Contact part 133 may be moved along the longitudinal axis of first pickup roller 130 to provide the coating fluid at a different location on transfer roller 120. Similarly, second pickup roller 140 includes a contact part 143 rotationally coupled to transfer roller 120 to provide the coating fluid. Contact part 143 has a longitudinal length less than or equal to the longitudinal length of transfer roller 120. Contact part 143 may be moved along the longitudinal axis of second pickup roller 140 to provide a coating fluid at a different location on transfer roller 120. In some examples, contact part 133 and contact part 143 may be moved manually or automatically along respective longitudinal axes. In some examples, contact part 133 and contact part 143 may be of the same length or a different length. In an example, contact part 133 and contact part 143 may be positioned to partially or completely align with each other in a longitudinal direction to provide coating fluid of a certain width to transfer roller 120 at a certain location. For example, as shown in FIG. 3, contact part 133 and contact part 143 partially overlap to provide coating fluid of a longitudinal length 129 to transfer roller 120. In such an example, if contact part 133 and/or contact part 143 was moved along its longitudinal axis, i.e., parallel to longitudinal length 129, the amount of coating fluid to be deposited on transfer roller 120 may be changed. In other words, as the position of contact part 133 and contact part 143 is moved, the longitudinal length 129 of coating fluid provided to first transfer roller 120 is moved or changes in longitudinal length.

In some examples, a wiper 125 may be coupled to a transfer roller 120 to remove some coating fluid from transfer roller 120. In such an example, wiper 125 may be used to control the amount of coating fluid provided to first press roller 112. In some examples, the removed coating fluid may be provided to a fluid reservoir 150 and thereby recycled in printing press 100.

In the example of FIGS. 1-3, each of first press roller 112 and second press roller 114 rotate about its respective longitudinal axis as print medium 190 moves through printing press 100. Similarly, each of transfer roller 120, first pickup roller 130, and second pickup roller 140 rotate about its respective longitudinal axis when print medium 190 moves along media path 110 through printing press 100.

In some examples, printing press 100 may include a controller 105 to determine the width and location of the coating fluid to be applied to transfer roller 120 according to a width of print medium 190. In such an example, controller 105 may provide instructions for manually adjusting the position of first pickup roller 130 and second pickup roller 140 to a user via a user interface (such as a monitor, a graphical user interface, etc.), a message (e.g., an email message, a SMS message, etc.), or any other mechanism. In other examples, controller 105 may control the automatic movement of contact part 133 and contact part 143 to the determined width and location. For example, contact part 133 and contact part 143 may be automatically moved via pulley. In such an example, in response to receiving an image to be printed on to print medium 190, controller 105 determines the width and location of coating fluid to be applied to print medium 190 and controls the automatic movement of contact part 133 and contact part 143 to the determined location and to form the determined width. In other examples, contact part 133 and/or contact part 143 may be moved by pushing first pickup roller 130 and second pickup roller 140, respectively, along its longitudinal axis.

Referring to FIG. 3, the width of coating fluid to be applied to transfer roller 120 may be adjusted according to the relative position of contact part 133 along the longitudinal axis of first pickup roller 130 and contact part 143 along the longitudinal axis of second pickup roller 140. For example, when aligned with each other, the width of coating fluid applied to transfer roller 120 may be the same length along a longitudinal axis as the longer of contact portion 133 and contact portion 143. In another example, contact portion 133 and contact portion 143 may be of the same length along its respective longitudinal axis and the width of the coating fluid applied to transfer roller 120 may be the same length as either contact portion 133 or contact portion 134 along its respective longitudinal axis when contact portion 133 and contact portions 143 are aligned. In some examples, first pickup roller 130 and second pickup roller 140 may deposit a coating fluid having a thickness of approximately 1-100 micrometers on transfer roller 120.

Figure 4:
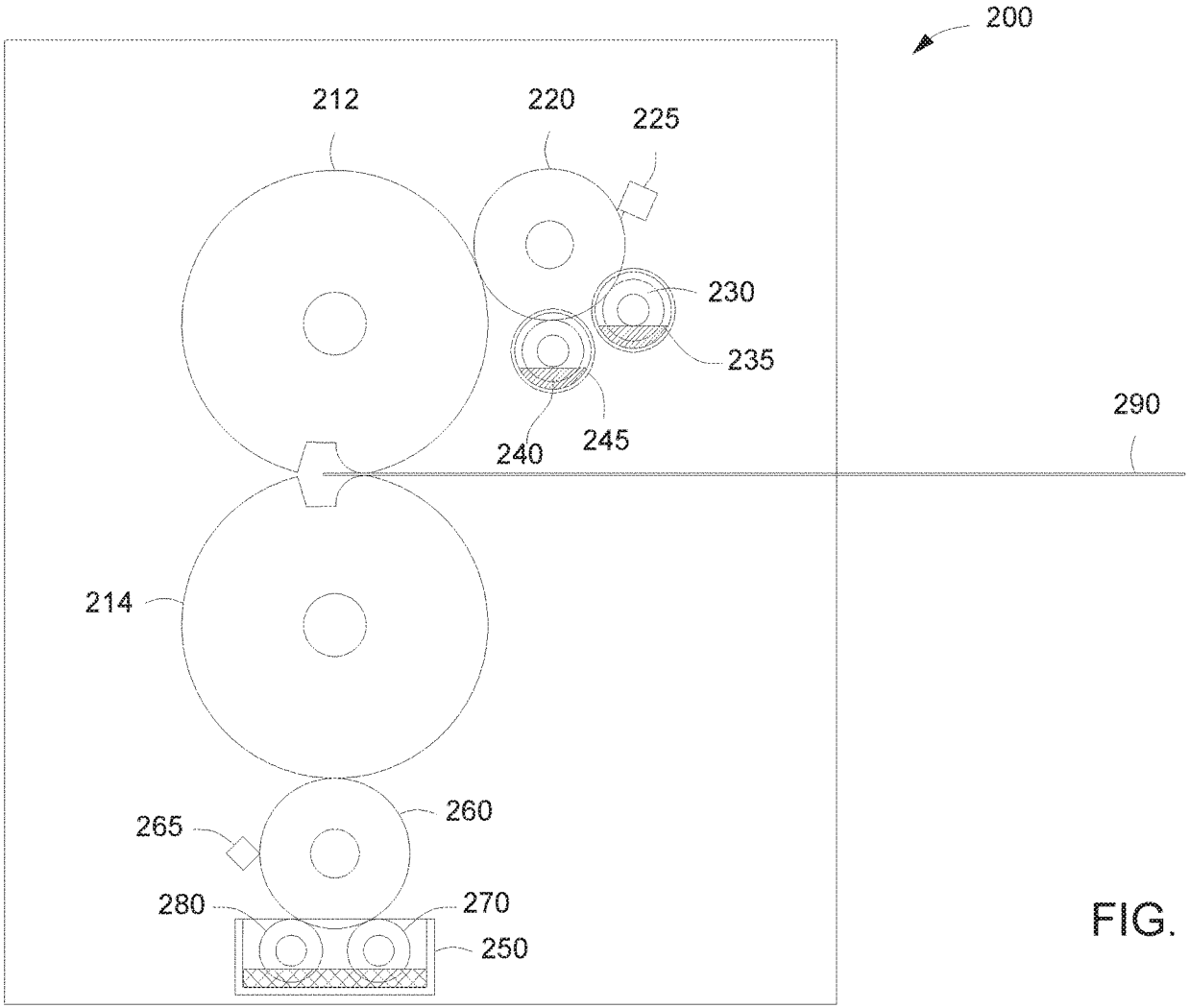
FIG. 4 is a schematic cross-sectional view of a printing press according to an example.
Figure 5:
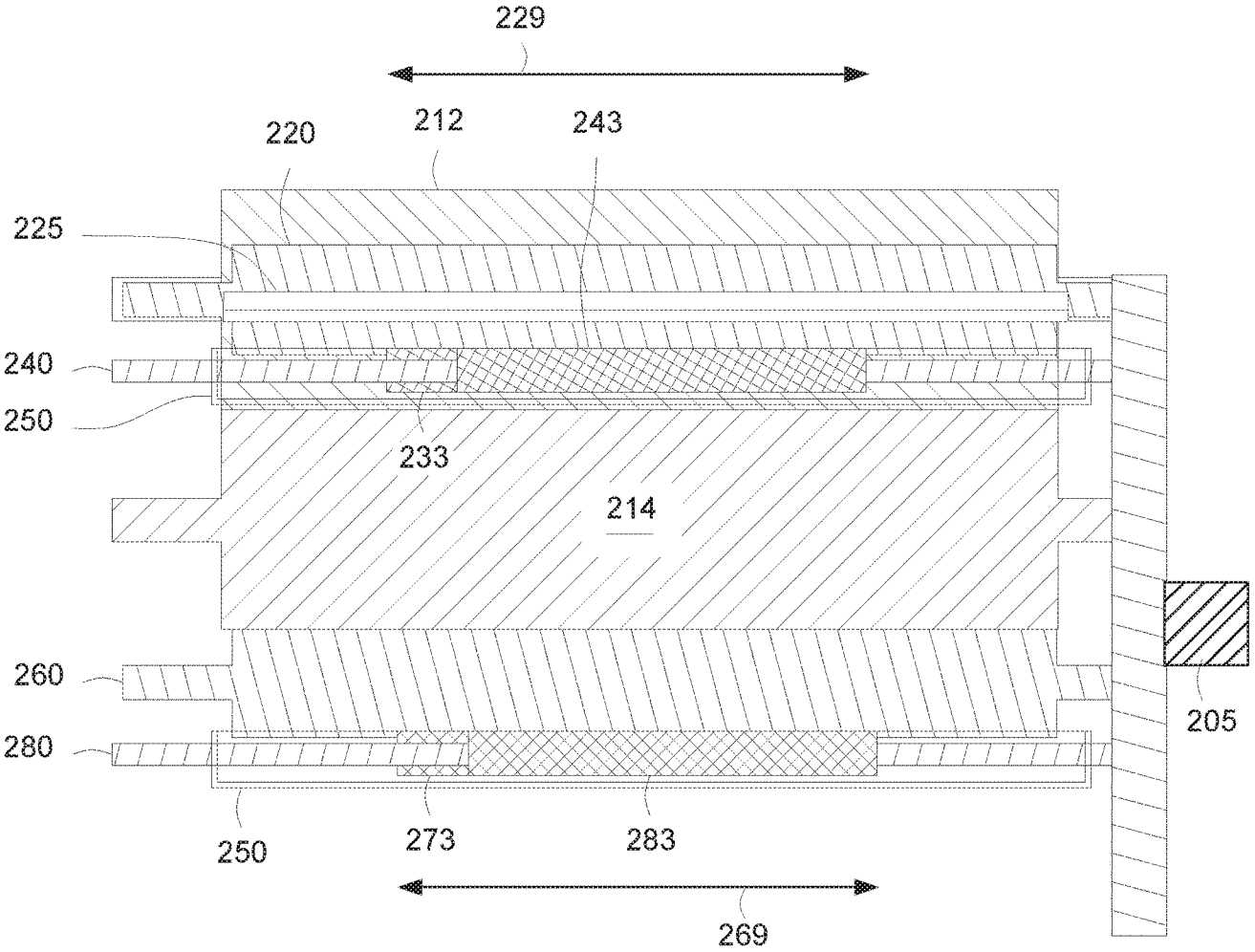
FIG. 5 is a partial schematic side perspective view of the printing press of FIG. 4 according to an example.

FIG. 4 is a schematic cross-sectional view of a printing press 200 according to an example. FIG. 5 is a partial schematic side perspective view of printing press 200 of FIG. 4 according to an example. Printing press 200 includes a first press roller 212 rotationally coupled to a second press roller 214 to transfer a coating fluid onto a print medium 290. In the example of FIGS. 4-5, first press roller 212 is to apply a coating fluid to one side of print medium 290 and second press roller 214 is to apply coating fluid to the other side of print medium 290. The coating fluid applied by first press roller 212 and second press roller 214 may be any fluid or compound to be disposed on print medium 290 including a primer, a toner, a printing material, a finishing fluid, etc. In some examples, the coating fluid applied by first press roller 212 and second press roller 214 may be the same coating fluid or different coating fluids. In some examples, first press roller 212 and second press roller 214 may deposit a coating fluid having a thickness of approximately 0.1-10 micrometers on print medium 290, respectively.

A first transfer roller 220 is rotationally coupled with first press roller 212 to provide the coating fluid. First transfer roller 220 may receive the coating fluid from a first pickup roller 230 and a second pickup roller 240. Although depicted with two pickup rollers (first pickup roller 230 and second pickup roller 240), the examples are not limited thereto and any number of pickup rollers may be used. In some examples, a first wiper 225 may be coupled to first transfer roller 220 to remove coating fluid from first transfer roller 220. In such an example, first wiper 225 may be used to control the amount of coating fluid provided to first press roller 212. In some examples, the removed coating fluid may be provided to a first fluid reservoir 235 and/or a second fluid reservoir 245 and thereby recycled in printing press 200. First pickup roller 230 may be in first fluid reservoir 235 and second pickup roller 240 may be in second fluid reservoir 245 to pick up the coating fluid to provide to first transfer roller 220. However, the examples are not limited thereto and first pickup roller 230 and second pickup roller 240 may receive the coating fluid via any type of coating applicator, such as, a spray nozzle, etc. In some examples, the coating fluid in first reservoir 235 and second reservoir 245 may be the same or different coating fluids. In some examples, first pickup roller 230 and second pickup roller 240 may deposit a coating fluid having a thickness of approximately 1-100 micrometers on first transfer roller 220.

A second transfer roller 260 is rotationally coupled to second press roller 214 to provide the coating fluid. Second transfer roller 260 may receive the coating fluid from a third pickup roller 270 and a forth pickup roller 280. Although depicted with two pickup rollers (third pickup roller 270 and forth pickup roller 280), the examples are not limited thereto and any number of pickup rollers may be used. In some examples, a second wiper 265 may be coupled to second transfer roller 260 to remove coating fluid from second transfer roller 260. In such an example, second wiper 265 may be used to control the amount of coating fluid provided to second press roller 214. In some examples, the removed coating fluid may be provided to a fluid reservoir 250 and thereby recycled in printing press 200. Third pickup roller 270 and fourth pickup roller 280 may be in third fluid reservoir 250 to pick up the coating fluid to provide to second transfer roller 260. However, the examples are not limited thereto and third pickup roller 270 and fourth pickup roller 280 may receive the coating fluid via any type of coating applicator, such as, a spray nozzle, etc. In some examples, third pickup roller 270 and forth pickup roller 280 may deposit a coating fluid having a thickness of approximately 1-100 micrometers on second transfer roller 260.

In the example of FIGS. 4-5, each of first press roller 212 and second press roller 214 rotate about its respective longitudinal axis as print medium 290 moves through printing press 200. Similarly, first transfer roller 220, second transfer roller 260, first pickup roller 230, second pickup roller 240, third pickup roller 270, and fourth pickup roller 280 rotate about its respective longitudinal axis when print medium 290 moves through printing press 200.

First pickup roller 230 includes a contact part 233 which is rotationally coupled to first transfer roller 220 to provide the coating fluid. Contact part 233 has a longitudinal length less than or equal to the longitudinal length of first transfer roller 220 to provide coating fluid to a portion of first transfer roller 220. Contact part 233 may be moved along its longitudinal axis to provide a coating fluid at a different location on first transfer roller 220. Similarly, second pickup roller 240 includes a contact part 243 rotationally coupled to first transfer roller 220 to provide the coating fluid. Contact part 243 has a longitudinal length less than or equal to the longitudinal length of first transfer roller 220. Contact part 243 may be moved along its longitudinal axis to provide a coating fluid at a different location on first transfer roller 220. In some examples, each contact part 233 and contact part 243 may be moved manually or automatically along its respective longitudinal axis. In some examples, contact part 233 and contact part 243 may of the same length or a different length. In an example, contact part 233 and contact part 243 may be positioned to partially or completely overlap each other in a longitudinal direction to provide coating fluid of a certain width to first transfer roller 220 at a certain location. For example, as shown in FIG. 5, contact part 233 and contact part 243 partially overlap to provide coating fluid of a longitudinal length 229 to first transfer roller 220. In such an example, if contact part 233 and/or contact part 243 was moved along its longitudinal axis, i.e., parallel to longitudinal length 229, the amount of coating fluid to be deposited on first transfer roller 220 may be changed. In other words, as the position of contact part 243 and contact part 233 is moved, the longitudinal length 229 of coating fluid provided to first transfer roller 220 is moved or changes in longitudinal length (see for comparison longitudinal length 129 of FIG. 1).

Third pickup roller 270 includes a contact part 273 which is rotationally coupled to second transfer roller 260 to provide the coating fluid. Contact part 273 has a longitudinal length less than or equal to the longitudinal length of second transfer roller 260 to provide coating fluid to a portion of second transfer roller 260. Contact part 273 may be moved along its longitudinal axis to provide a coating fluid at a different location on second transfer roller 260. Similarly, fourth pickup roller 280 includes a contact part 283 rotationally coupled to second transfer roller 260 to provide the coating fluid. Contact part 283 has a longitudinal length less than or equal to the longitudinal length of transfer roller 260. Contact part 283 may be moved along its longitudinal axis to provide a coating fluid at a different location on second transfer roller 260. In some examples, each of contact part 273 and contact part 283 may be moved manually or automatically along its respective longitudinal axis. In some examples, contact part 273 and contact part 283 may be of the same length or a different length. In an example, contact part 273 and contact part 283 may be positioned to partially or completely align with each other in a longitudinal direction to provide coating fluid of a certain width to second transfer roller 260 at a certain location. For example, as shown in FIG. 5, contact part 273 and contact part 283 partially overlap to provide coating fluid of a longitudinal length 269 to second transfer roller 260. In such an example, if contact part 273 and/or contact part 283 was moved along its longitudinal axis, i.e., parallel to longitudinal length 269, the amount of coating fluid to be deposited on second transfer roller 260 may be changed. In other words, as the position of contact part 273 and contact part 283 is moved, the longitudinal length 269 of coating fluid provided to second transfer roller 260 is moved or changes in longitudinal length (see for comparison longitudinal length 129 of FIG. 1). The amount of coating fluid deposited on the print medium may be between 0.1 micrometers-10 micrometers.

A controller 205 of printing press 200 may determine the width and location of the coating fluid to be applied to first transfer roller 220 and second transfer roller 260 according to a width of a print job (i.e., printing width) on print medium 290. In such an example, controller 205 may provide instructions for manually adjusting the position of first pickup roller 230, second pickup roller 240, third pickup roller 270, and fourth pickup roller 280 to a user via a user interface (such as a monitor, a graphical user interface, etc.), a message (e.g., email message, SMS message, etc.), or any other mechanism. In other examples, controller 205 may control the automatic movement of contact part 233, contact part 243, contact part 273, and contact part 283 to the determined width and location. For example, contact part 233, contact part 243, contact part 273, and contact part 283 may be automatically moved via a pulley. In such an example, in response to receiving an image to be printed on to print medium 290, controller 205 determines the width and location of coating fluid to be applied to print medium 290 and controls the automatic movement of contact part 233 and contact part 243 to form longitudinal length 229 and contact part 273 and contact part 283 to form longitudinal length 269. In other examples, one or more of contact part 233, contact part 243, contact part 273, and contact part 283 may be moved by pushing its respective pick up roller along its longitudinal axis.

Figure 6:
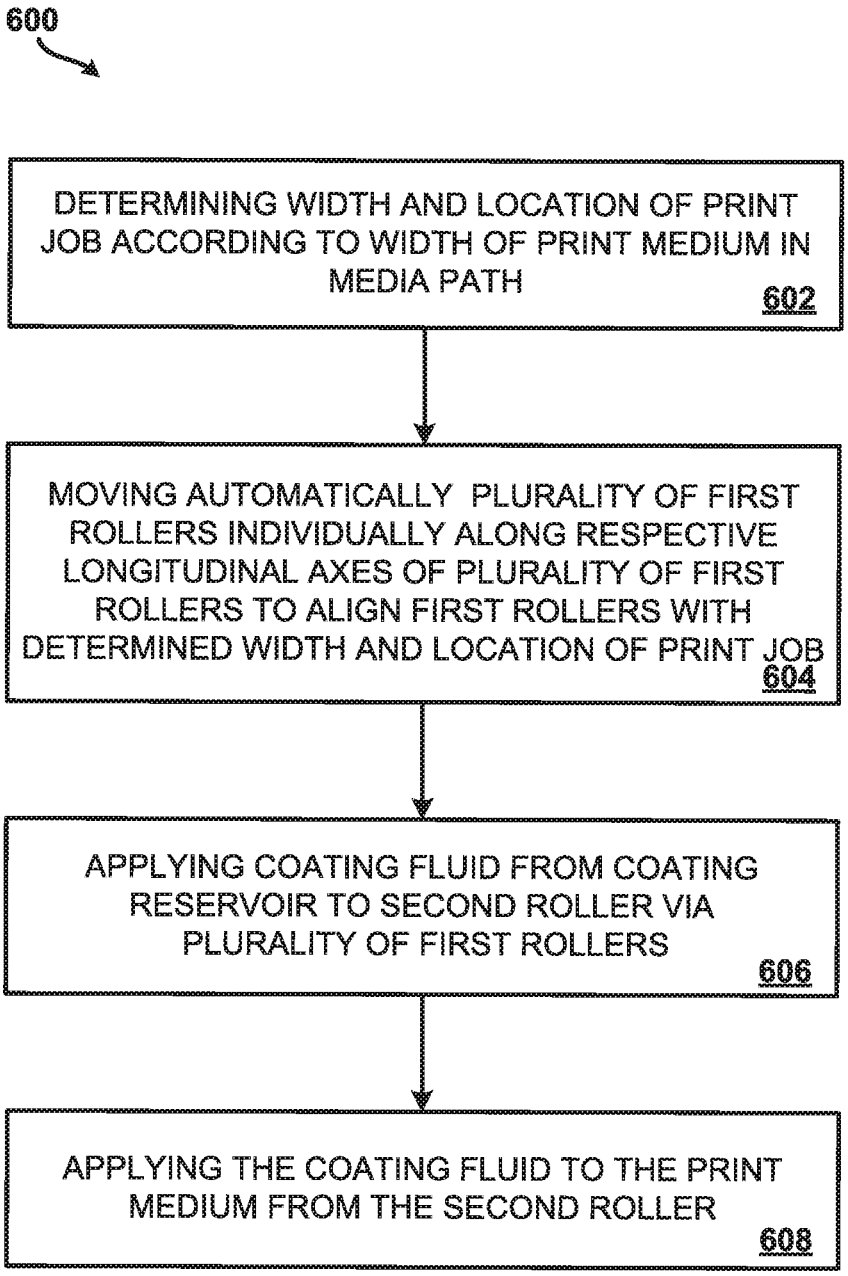
FIG. 6 is a flowchart of an example method for applying coating fluid to a print medium according to an example.

FIG. 6 is a flowchart of an example method 600 for applying coating fluid to a print medium according to an example. Although execution of method 600 is described below with reference to printing press 100 described above, other suitable systems (printing press 200) for the execution of method 600 can be utilized. Additionally, implementation of method 600 is not limited to such examples.

At 602 of method 600, a controller of printing press 100 may determine a width and a location of a print job according to a width of print medium 190 in media path 110. In an example, print medium 190 may be at least one of a paper substrate, a plastic substrate, and a metal substrate. In some examples, the controller 105 may determine a width of the print medium 190 by receiving the width of the medium from a user interface device (not shown).

At 604, controller 105 of printing press 100 may automatically move first pickup roller 130 and second pickup roller 140 individually along respective longitudinal axes of first pickup roller 130 and second pickup roller 140 to align first pickup roller 130 and second pickup roller 140 with the width and the location of the print job. In other words, contact portion 133 of first pickup roller 130 and contact portion 143 of second pickup roller 140 may be positioned according to the determined width and location of the print job. In the example of FIG. 6, the longitudinal width of contact portion 133 and contact portion 143 may be less than or equal to the longitudinal width of the transfer roller 120.

At 606, the coating fluid from a coating application, such as coating reservoir 150, is applied to a transfer roller 120 via first pickup roller 130 and second pickup roller 140. In some examples, a second transfer roller (e.g., second transfer roller 260) may be rotationally coupled to one or more press rollers to provide a coating fluid to print medium 190.

At 608, the coating fluid is applied to print medium 190 from the transfer roller 120 via first press roller 112. In an example the coating fluid may be at least one of a primer, a liquid toner, a printing material, a finishing fluid, etc.

Although the flowchart of FIG. 6 shows a specific order of performance of certain functionalities, method 600 is not limited to that order. For example, the functionalities shown in succession in the flowchart may be performed in a different order, may be executed concurrently or with partial concurrence, or a combination thereof. In some examples, functionalities described herein in relation to FIG. 6 may be provided in combination with functionalities described herein in relation to any of FIGS. 1-5.

While certain implementations have been shown and described above, various changes in form and details may be made. For example, some features that have been described in relation to one implementation and/or process can be related to other implementations. In other words, processes, features, components, and/or properties described in relation to one implementation can be useful in other implementations. Furthermore, it should be understood that the systems, apparatuses, and methods described herein can include various combinations and/or sub-combinations of the components and/or features of the different implementations described. Thus, features described with reference to one or more implementations can be combined with other implementations described herein.

The above discussion is meant to be illustrative of the principles and various examples of the present disclosure. Numerous variations and modifications will become apparent to those skilled in the art once the above disclosure is fully appreciated. It is intended that the following claims be interpreted to embrace all such variations and modifications.

What is claimed is:

1. An apparatus, comprising:

a first roller having a first length, the first roller extending along a first longitudinal axis;

a second roller in contact with the first roller at a first contact part on the first roller, the second roller to apply a coating fluid to the first contact part on the first roller, the second roller extending and being movable along a second longitudinal axis;

a third roller in contact with the first roller at a second contact part on the first roller, the third roller to apply the coating fluid to the second contact part on the first roller, the third roller extending and being movable along a third longitudinal axis, and the third longitudinal axis being offset from the second longitudinal axis;

a fluid reservoir to hold the coating fluid, wherein the second roller and the third roller are to receive the coating fluid directly from the fluid reservoir while being movable along the second longitudinal axis and the third longitudinal axis, respectively; and a controller to:

determine a width and location of the coating fluid to be applied to a media; and control movement of the second roller along the second longitudinal axis to move the first contact part on the first roller and the third roller along the third longitudinal axis to move the second contact part on the first roller to vary a width of the coating fluid applied to the first roller from the second roller and the third roller according to the determined width and location of the coating fluid of the media.

2. The apparatus of claim 1, wherein the first contact part and the second contact part each have lengths that are less than or equal to the first length of the first roller.

3. The apparatus of claim 1, further comprising a fourth roller in contact with the first roller at a third contact part on the first roller, the fourth roller to apply the coating fluid to the third contact part of the first roller, the fourth roller being moveable along a fourth longitudinal axis.

4. A system, comprising:

a coating applicator to hold a coating fluid;

a first pickup roller extending along a first longitudinal axis, the first pickup roller to directly receive the coating fluid held in the coating applicator while being movable along the first longitudinal axis;

a second pickup roller extending along a second longitudinal axis, the second pickup roller to receive the coating fluid held in the coating applicator while being movable along the second longitudinal axis, the second longitudinal axis being offset with respect to the first longitudinal axis;

a first transfer roller in contact with the first pickup roller at a first contact part and in contact with the second pickup roller at a second contact part, wherein the first pickup roller and the second pickup roller are each shorter in length than the first transfer roller, and wherein the first transfer roller is to receive coating fluid at the first contact part and the second contact part and to apply the received coating fluid to a first side of a medium; and a controller to:

determine a width and a location on the medium at which the coating fluid is to be applied;

control movement of the first pickup roller along the first longitudinal axis based on the determined width and location on the medium at which the coating fluid is to be applied; and control movement of the second pickup roller along the second longitudinal axis based on the determined width and location on the medium at which the coating fluid is to be applied.

5. The system of claim 4, wherein the variable width of coating fluid applied onto the first transfer roller is determined according to a width of the medium upon which the coating fluid is to be applied.

6. The system of claim 5, wherein the controller is further to determine a width of the medium by receiving the width of the medium from a user interface device.

7. The system of claim 4, further comprising a wiper to remove excessive coating fluid from the transfer roller.

8. The system of claim 4, wherein the coating fluid is at least one of a primer, a liquid toner a printing material, and a finishing fluid.

9. The system of claim 4, further comprising:

a plurality of second rollers;

a second coating applicator to apply the coating fluid to the plurality of second rollers; and a second transfer roller in contact with the plurality of second rollers to receive the coating fluid, wherein a media path is to apply the coating fluid from the second transfer roller to a second side of the medium, wherein the plurality of second rollers are shorter than the second transfer rollers and are individually movable along its longitudinal axes such that they may be positioned to apply a variable width of the coating fluid onto the second transfer roller.

10. The apparatus of claim 1, wherein the controller is to control movement of the second roller and the third roller while the second roller and the third roller are in contact with the coating fluid in the fluid reservoir.

11. The system of claim 4, wherein the coating applicator is a fluid reservoir to hold the coating fluid and wherein the first pickup roller and the second pickup roller extend into the fluid reservoir.

12. The system of claim 11, wherein the controller is to control movement of the first pickup roller and the second pickup roller while the first pickup roller and the second pickup roller are in contact with the coating fluid in the fluid reservoir.

* * * * *